US006273213B1

(12) United States Patent
Callas et al.

(10) Patent No.: US 6,273,213 B1
(45) Date of Patent: Aug. 14, 2001

(54) NOISE SUPPRESSION LOUVER HAVING HORIZONTAL AND VERTICAL SLATS

(75) Inventors: James J. Callas; David C. Copley, both of Peoria; Emile E. Damotte, Pekin; Kristian M. Stoeckel, Peoria, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/465,711

(22) Filed: Dec. 17, 1999

(51) Int. Cl.[7] ..... G10K 11/04

(52) U.S. Cl. ..... 181/200; 181/202; 181/204

(58) Field of Search ..... 181/200, 202, 181/203, 204, 205, 224, 225, 229, 210

(56) References Cited

U.S. PATENT DOCUMENTS

| | | | | |
|---|---|---|---|---|
| 2,759,555 | * | 8/1956 | Baruch | 181/202 |
| 3,762,489 | * | 10/1973 | Proksch et al. | 181/200 |
| 3,897,850 | | 8/1975 | Thompson et al. . | |
| 3,923,114 | | 12/1975 | Suzuki . | |
| 4,334,588 | | 6/1982 | Tezuka et al. . | |
| 4,335,797 | | 6/1982 | Simmons . | |
| 5,625,172 | | 4/1997 | Blichmann et al. . | |

* cited by examiner

*Primary Examiner*—Khanh Dang
(74) *Attorney, Agent, or Firm*—Steven G. Kibby

(57) ABSTRACT

A noise suppression louver for an enclosure, in particular, an apparatus for suppressing sound at the openings which allow air to enter or exit an internal combustion engine enclosure. The louver comprises a matrix of intersecting horizontal and vertical passive sound absorptive slats.

19 Claims, 3 Drawing Sheets

NOISE SUPPRESSION LOUVER HAVING HORIZONTAL AND VERTICAL SLATS

TECHNICAL FIELD

The present invention relates to improvements in noise suppression apparatus, and more particularly, to an engine enclosure having a louver formed by intersecting horizontal and vertical passive sound absorptive slats.

BACKGROUND ART

Enclosures for internal combustion engines, such as those used on earthmoving machines and mobile power stations, are designed to minimize the sound levels outside the engine compartment. Typically this is accomplished by adding sound insulation to the wall of the enclosure. However, the engine enclosure must allow for sufficient inlet and exit airflow capacity is to support combustion and to provide cooling air for the engine. Air inlets are provided in the enclosure walls, thereby significantly increasing the sound levels outside the compartment.

It is known in the art to cover the enclosure air inlets and exits with a louver formed of sound absorptive material, typically in the shape of straight or V-shaped slats. It should be noted that although the term "louver" may refer both to a slatted opening and to the slats the themselves, this description for the sake of clarity defines it to be limited to the first described usage.

A problem with this type of silencer is that a trade-off must be made between the desired noise attenuation and the air pressure drop across the panel. If the slats are placed in close proximity to one another, substantial broad-band noise reduction can be accomplished, but tending to increase the pressure loss across the panel and thereby reduce the combustion or cooling airflow through the engine compartment. An increase in fan speed to compensate for the lost airflow increases the fan noise, even to the point of eliminating any net gain in noise attenuation. The present invention is directed to methods and apparatus for addressing one or more of the problems set forth above.

DISCLOSURE OF THE INVENTION

A noise suppression louver is provided for an engine enclosure having an air opening. The louver includes a first plurality of slats extending substantially horizontally across the air opening, and a second plurality of slats extending substantially vertically across the air opening and intersecting the first plurality. The first and second plurality of slats include a passive sound absorptive material.

In another embodiment, a plurality of walls form a compartment enclosing an internal combustion engine and provide at least one air opening into the compartment. The engine includes an axial flow fan for moving air within the compartment. A radiator assembly circulates coolant to and from the engine.

A louver is provided having a plurality of intersecting vertical slats and horizontal slats extending across the air opening of the engine compartment, each slat including passive sound absorptive material to attenuate engine noise transmitted through the opening.

Other details and advantages of the invention will become apparent by reference to the following description and illustrative drawings of certain present embodiments thereof and certain present preferred methods of practicing the same proceeds.

Brief Description of the Drawings

A more complete appreciation of this invention will be understood by reference to the following detailed description when considered in conjunction with the accompanying drawings in which like reference symbols indicate the same or similar components, wherein.

BEST MODE FOR CARRYING OUT THE INVENTION

Figure 1:
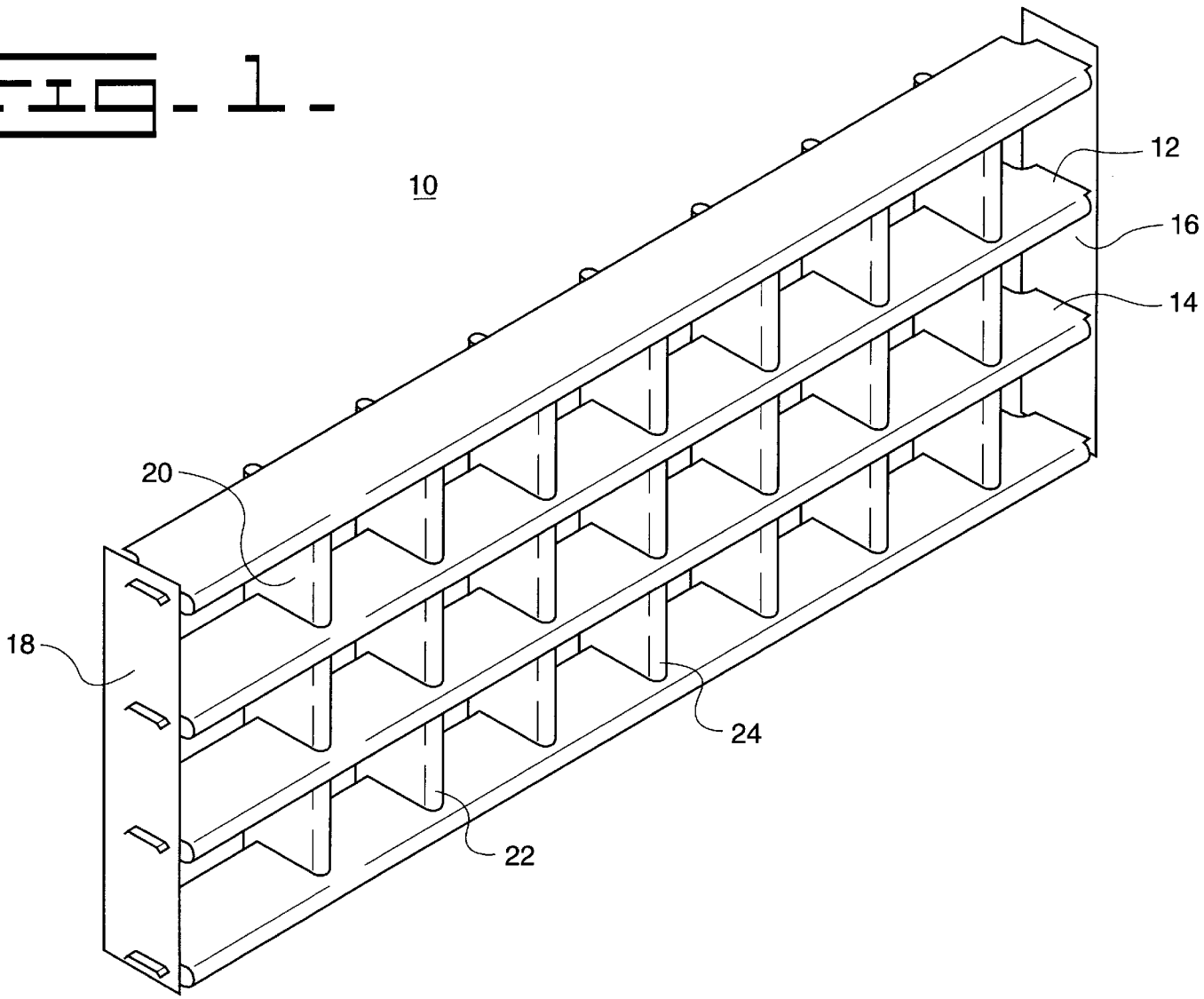
FIG. 1 is a perspective view of a louver arrangement according to one aspect of the present invention.

Turning now to the drawings and referring first to FIG. 1, a louver 10 according to the present invention comprises a plurality of parallel slats 12,14 extending horizontally between first opposite edges of a frame. The horizontal slats 12,14 are at least partially intersected by a plurality of parallel slats 20,22,24 extending vertically between second opposite edges, creating a two-dimensional matrix of openings within the louver for air to pass between. The ends of the slats 12,14 may be affixed to frame members 16, 18 or the outmost slats may themselves comprise frame members, defining an outer periphery or frame of the louver 10. The horizontal slats 22,24 at least partially intersect the vertical slats 22,24,26 so as to reduce the overall depth of the louver 10, although as illustrated they need not lie entirely in the same planes.

Figure 3:
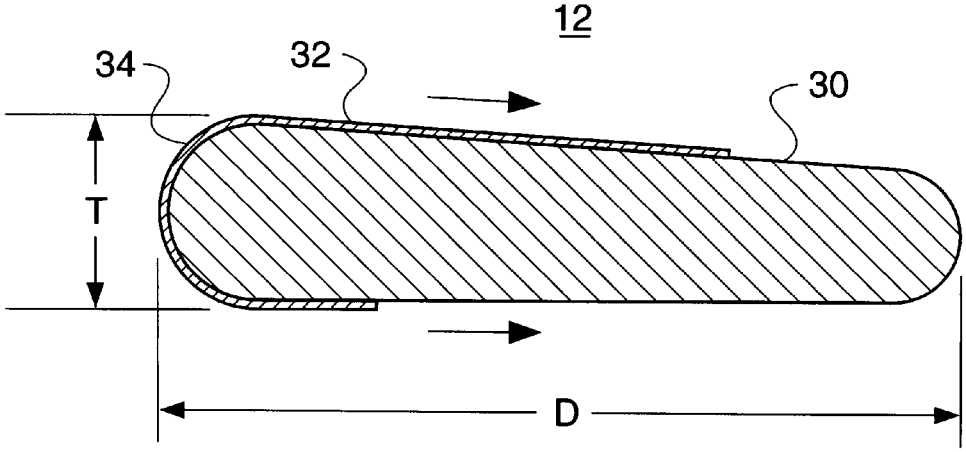
FIG. 3 is a cross-sectional view of an individual slat according to another aspect of the present invention.

FIG. 3 is a cross section taken across the length of a representative horizontal slat 12. Each slat comprises a passive sound absorptive member 30 of appropriate acoustical material, such as fiberglass batt or open-cell polyurethane, and preferably has a substantially uniform thickness T and depth D along its length. The member 30 may also be tapered from front to back along its depth, rounded at the edges, or otherwise shaped or refined in cross-section to adjust aerodynamic flow, without departing from the present invention.

According to one preferred embodiment, at least the horizontal slats 12, 14 also comprise a channel 34 covering the nose of the member 30, and optionally may extend a straight leg 32 along an upper surface of the member 30. The channel 34 provides strength and protects those portions of member 30 directly exposed to debris. As described hereafter, a louver according to the present invention may have application as a sound absorptive grill for the engine enclosure of a mobile machine, requiring protection against rocks and dirt.

Figure 2:
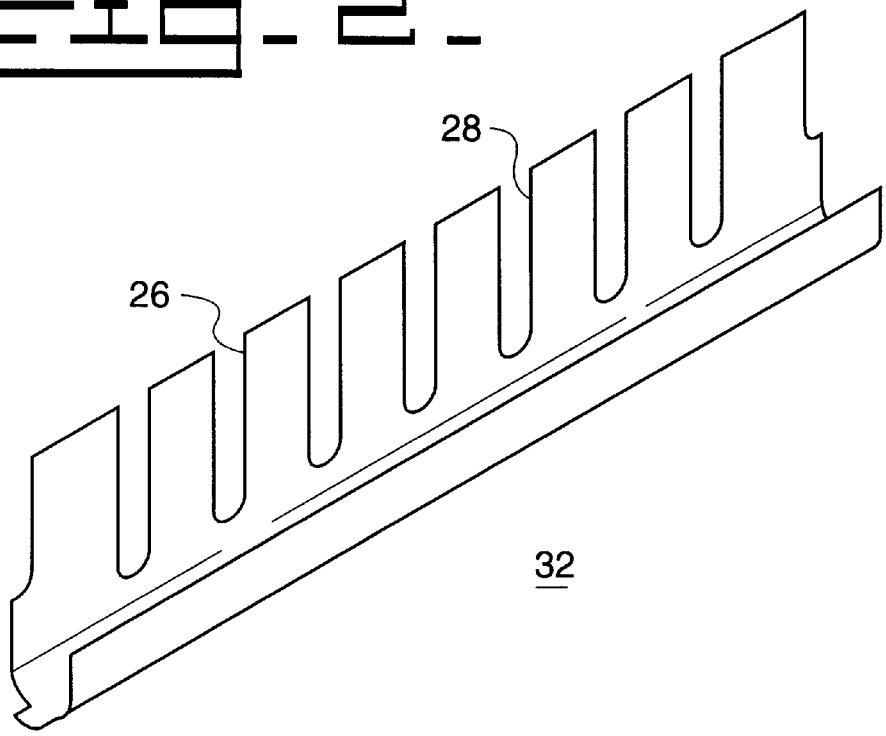
FIG. 2 is a perspective view of a rigid plate for partially covering the sound absorptive material of a slat according to another aspect of the present invention.

The channel 34 is preferably composed of steel or other rigid material, which tends to reflect rather than absorb noise. Accordingly, in a presently preferred embodiment, the straight leg 32 of the channel 34 is kept relatively short or even eliminated entirely, in order to maximize the amount of exposed absorptive material. FIG. 2 illustrates a perspective view of a channel 32 with the member 30 removed. A plurality of notches extend through each slat, and align with corresponding notches 26,28 in the straight leg 32 when present, to permit interlocking of the horizontal and vertical slats.

Additional embodiments of the present invention are described below, using like reference numerals.

Industrial Applicability

The operation of the present invention is best described in relation to its use in mobile machines. For example, an off-highway mining truck powered by a large diesel engine generates a significant amount of ambient noise in addition to that produced in the combustion exhaust. While mufflers can be used to reduce the noise output the exhaust system, additional measures must be taken to reduce the ambient noise produced by the engine to meet increasingly stringent environmental noise regulations.

Figure 4:
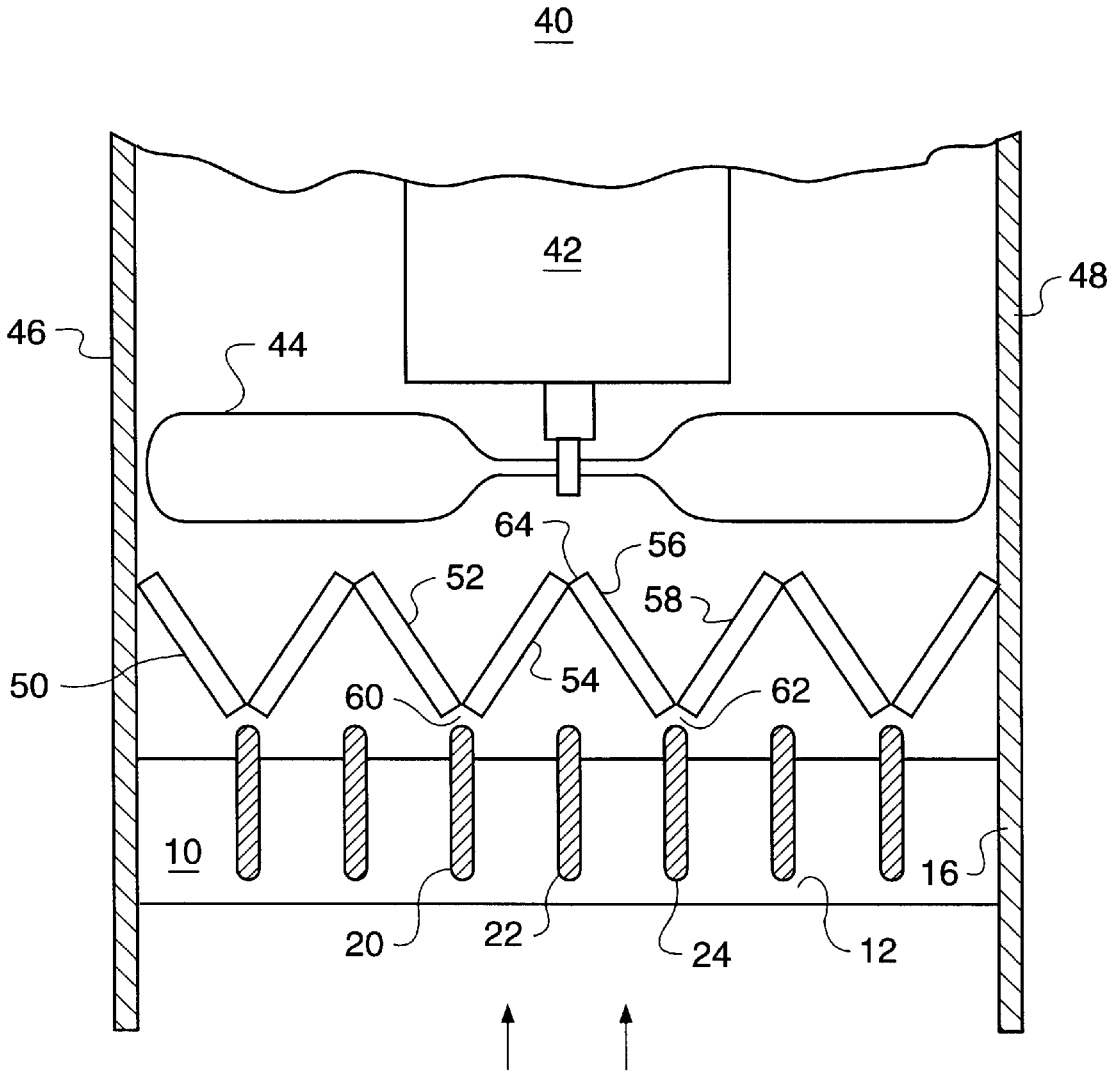
FIG. 4 is top view illustrating a preferred placement of certain slats when positioning the louver in the wall of an enclosure according to yet another aspect of the present invention.

A top cut-away view of an engine compartment utilizing a louver 10 according to the present invention is shown in FIG. 4. The compartment 40 includes walls 46,48 enclosing an internal combustion engine 42 having an axial flow fan 44 for moving air within the compartment. Air is drawn by the fan 44 into an opening in the compartment 10 through a radiator assembly circulating coolant to and from the engine. A louver 10 includes a plurality of vertical 20,22,24 and horizontal 12 passive sound absorptive slats extending across the air opening as described above, in order to attenuate the engine noise transmitted through the opening.

A louver, as used herein, includes framed air openings formed in a wall of the compartment, such as side walls 46,48, in a hood (not shown), or even an arrangement of slats according to the invention forming a grill across the entire front side of the engine compartment 10, as illustrated in FIG. 4. Furthermore, although cooling air is illustrated by the arrow in FIG. 4 as entering the compartment through louver 10, the fan 44 direction could instead be reversed to blow air through the radiator and louver 10 out of the compartment 10 without departing from the spirit and scope of the invention.

Radiator assemblies having interconnected modular cores 52,54,56,58 in the configuration shown in FIG. 4 have been known for some time, and are commonly referred to as "folded core" radiators. This is configuration offer advantages over straight, single core arrangements, both in terms of cost to replace only a single damaged module and in terms of cooling capacity due to the ability to increase the cooling surface in a given width compartment without increasing frontal area. Stated another way, more fluid-carrying tubes having any particular number of fins per inch can be installed, due to the zig-zag path the modular cores 50,52 taken across the compartment.

Fan noise is a significant component of the ambient noise produced by the machine. As the radiator or louver increase the air flow resistance, referred to herein as pressure drop, the fan speed must be increased to maintain cooling with a consequent increase in noise. A point is quickly reached where increasing the size of, or reducing the spacing between, the slats of the louver results in no net gain in sound suppression.

According to one embodiment of the invention in combination with a folded core radiator, at least some of the vertical slats 20, 24 of the louver 10 are positioned in alignment with the spaces 60,62 created where the modular cores 52, 54 and 56,58 are joined. These spaces, commonly referred to as "trash gaps", contribute little to engine cooling, so that placement of the vertical slats in alignment with the gaps where possible helps to minimize the impact of the louver on engine cooling. Ideally, all of the vertical members are aligned with a trash gap nearest the louver 10, and most preferably are substantially adjacent thereto. If the number of vertical slats exceeds the number of adjacent trash gaps when larger modular cores are provided however, some of the slats 22 may be placed intermediate the gaps or aligned with aligned with trash gaps 64 further away from the louver 10.

An important aspect of the present invention is the discovery that a combination of vertical and horizontal slats can provide increased noise absorption over similarly sized slats all extending across the opening in only one direction. The term "percentage open area" is used herein to refer to the proportion of open space through which air can pass in a cross section of the louver perpendicular to the direction of air flow. In other words, the spaces not blocked by any slats.

Insertion loss tests were conducted to compare a horizontal slat variant with a matrix of intersecting horizontal and vertical slats, both having two inch thick louvers and a 66% open area. At louver depths greater than about 200 millimeters (eight inches), the matrix outperformed the horizontal variants by as much as 3-4 dBA, with every indication that the performance divergence continues to increase with greater depth.

While certain present preferred embodiments of the invention and certain present preferred methods of practicing the same have been illustrated and described herein, it is to be distinctly understood that the invention is not limited thereto but may be otherwise variously embodied and practiced within the scope of the following claims.

What is claimed is:

1. A noise suppression louver for an engine enclosure having an air opening, comprising:

a frame forming an outer periphery of the air opening;

a first plurality of slats extending between opposite vertical edges of said frame substantially horizontally across the air opening;

a second plurality of slats extending substantially vertically across the air opening and intersecting said first plurality of slats, wherein said first and second plurality of slats comprise passive sound absorptive material.

2. The louver of claim 1, wherein said passive sound absorptive material is fiberglass batt.

3. The louver of claim 1, wherein at least said first plurality of slats further include a rigid channel partially covering and protecting said absorptive material.

4. The louver of claim 1, wherein at least said first plurality of slats further include a rigid J-channel covering a nose and surface of said absorptive material.

5. The louver of claim 1, wherein at least some of said slats incorporate notches for interlocking horizontal slats with vertical slats.

6. The louver of claim 1, wherein said slats have a depth of at least two hundred millimeters.

7. The louver of claim 1, wherein some of said first and second plurality of slats comprise frame members defining said frame.

8. A noise suppression louver for an engine enclosure having an air opening, comprising:

a first plurality of slats extending substantially horizontally across the air opening;

a second plurality of slats extending substantially vertically across the air opening and intersecting said first plurality of slats, wherein said first and second plurality of slats comprise passive sound absorptive material, at least said first plurality of slats further include a rigid channel partially covering and protecting said absorptive material and incorporate notches for interlocking with said second plurality of vertical slats.

9. A system, comprising:

a plurality of walls forming a compartment enclosing an internal combustion engine and having at least one air opening into said compartment, said engine including an axial flow fan for moving air within the compartment;

a radiator assembly circulating coolant to and from the engine; and a louver having a plurality of intersecting vertical slats and horizontal slats extending across the air opening of said compartment, said slats including passive sound absorptive material to attenuate engine noise transmitted through the opening.

10. The system of claim 9, further including a steel channel partially covering at least one of said first and second plurality of slats, wherein said louver forms a grill across the front side of the engine compartment.

11. The system of claim 9, wherein said radiator assembly is positioned intermediate said louver and said fan.

12. The system of claim 11, wherein said radiator assembly further includes a plurality of interconnected core modules arranged at angles to one another so as to create a gap between each module, and wherein at least some of said plurality of vertical slats a positioned in alignment with said gaps.

13. The system of claim 11, wherein said radiator assembly is a folded core having a plurality of trash gaps, and at least some of said plurality of vertical slats a positioned in alignment with said gaps.

14. The louver of claim 9, wherein at least some of slats incorporate notches for interlocking horizontal slats with vertical slats.

15. The louver of claim 9, wherein said slats have a depth of at least two hundred millimeters.

16. The system of claim 9, wherein said sound absorptive material comprises fiberglass batt.

17. A noise suppression louver for an engine enclosure having an air opening, comprising:

a first plurality of slats comprising sound absorptive material extending substantially horizontally across the air opening, said first plurality of slats further including a rigid J-channel covering a nose and an upper surface of said absorptive material; and, a second plurality of slats comprising sound absorptive material extending substantially vertically across the air opening and intersecting said first plurality of slats.

18. A noise suppression louver for an engine enclosure having an air opening, comprising:

a first plurality of horizontal slats composed of sound absorptive material extending across the air opening;

a second plurality of vertical slats composed of sound absorptive material extending across the air opening, at least some of said slats incorporating notches interlocking horizontal slats with vertical slats.

19. The louver of claim 18, wherein said interlocking horizontal and vertical slats create a two-dimensional matrix of air openings within the louver.

* * * * *